US009963900B2

(12) United States Patent
Stokes, Sr.

(10) Patent No.: US 9,963,900 B2
(45) Date of Patent: May 8, 2018

(54) SLIDE PLATFORM

(71) Applicant: Van Stokes, Sr., Delray Beach, FL (US)

(72) Inventor: Van Stokes, Sr., Delray Beach, FL (US)

( * ) Notice: Subject to any disclaimer, the term of this patent is extended or adjusted under 35 U.S.C. 154(b) by 0 days. days.

(21) Appl. No.: 15/599,824

(22) Filed: May 19, 2017

(65) Prior Publication Data

US 2017/0350151 A1 Dec. 7, 2017

Related U.S. Application Data

(60) Provisional application No. 62/344,097, filed on Jun. 1, 2016.

(51) Int. Cl.

| | |
|---|---|
| ***E04H 6/22*** | (2006.01) |
| ***E04H 6/34*** | (2006.01) |
| ***E04H 6/06*** | (2006.01) |
| *B65G 69/22* | (2006.01) |
| *E04H 6/30* | (2006.01) |

(52) U.S. Cl.

CPC ..... *E04H 6/34* (2013.01); *E04H 6/06* (2013.01); *E04H 6/22* (2013.01); *E04H 6/30* (2013.01)

(58) Field of Classification Search

CPC .. E04H 6/06; E04H 6/225; E04H 6/22; E04H 6/34; E04H 6/30; E04H 6/065; B65G 1/0492; B65G 69/005; B65G 69/22

USPC ..... 414/239, 240; 198/468.9

See application file for complete search history.

(56) References Cited

U.S. PATENT DOCUMENTS

| | | | | |
|---|---|---|---|---|
| 3,008,590 A * | 11/1961 | Alimanestiano | E04H 6/225 414/240 |
| 3,240,364 A * | 3/1966 | Kapnek | E04H 6/225 414/240 |
| 5,018,926 A * | 5/1991 | Sternad | B65G 1/06 414/232 |
| 8,613,582 B2 * | 12/2013 | Shani | E04H 6/245 414/232 |

(Continued)

FOREIGN PATENT DOCUMENTS

GB 2244267 * 11/1991 ..... E04H 6/22

*Primary Examiner* — James R Bidwell

(74) *Attorney, Agent, or Firm* — Timothy X. Gibson, Esq.; Gibson & Dernier LLP

(57) ABSTRACT

A sliding platform system for moving a vehicle parked on a platform, the sliding platform system including at least one rail and at least one vehicle platform slidably movable upon the at least one rail, a chain drive assembly comprising a chain, motor and sprockets, a chain guide channel positioned adjacent the at least one rail, and at least one latching mechanism mounted to the platform and slidably engaged in the chain guide channel, wherein the chain drive assembly is operably coupled to the latching mechanism and wherein a portion of the chain is positioned in the chain guide channel, wherein the chain guide channel includes at least one detent operable to engage the latching mechanism when the latching mechanism is positioned in alignment with the detent and to disengage the chain from a chain engagement element in the latching mechanism. The chain drive assembly is operable to move one or more platforms along the rail to pre-selected positions. The system may include a latch set device operable to move the latch mechanism to an engaged state with the chain.

14 Claims, 13 Drawing Sheets

(56) References Cited

U.S. PATENT DOCUMENTS

| | | | | |
|---|---|---|---|---|
| 8,734,078 | B2 * | 5/2014 | Benedict | E04H 6/225<br>414/239 |
| 2010/0014950 | A1 * | 1/2010 | Blackmore | E04H 6/065<br>414/229 |
| 2012/0039693 | A1 * | 2/2012 | Benedict | E04H 6/225<br>414/231 |

* cited by examiner

SLIDE PLATFORM

CROSS-REFERENCE TO RELATED APPLICATIONS

This non-provisional application claims the benefit of U.S. Provisional Patent Application Ser. No. 62/344,097 filed Jun. 1, 2016, the entirety of which is incorporated herein by reference.

FIELD OF THE INVENTION

The invention relates to parking mechanisms for automobiles and in particular, sliding platforms used to park automobiles.

BACKGROUND

Sliding platforms are useful in moving cars to be parked to maximize the space available for parking in a parking system, deck or lot. Sliding platforms are used to move vehicles to available space, such as behind equipment, walls and columns, which cannot be reached by normal means. Sliding platforms are also used in mechanical parking systems to free up space thus enabling other platforms to be moved to that space.

SUMMARY OF THE INVENTION

Sliding platforms are typically configured to be located on a sliding track or rail supported on the ground or in a structure and powered by an electric motor contained therein. Each sliding platform must be capable of moving in various directions and in random order, therefore each sliding platform contains its own electric motor which necessitates an electric distribution system having a wire flexibly connected to each sliding platform to provide power. The placement of the electric motor is critical so that it does not occupy space required for parking the vehicle and does not require the platform to be made larger. The speed at which the platform can be operated is dependent upon the size of the electric motor incorporated therein and the electrical distribution system connected thereto. Larger electric motors allow an increase of speed but at a significant increase in mounting space and cost.

There is a need in the art for a sliding platform system that does not require an electrical distribution system flexibly connected to individually mounted electric motors and a system that can be operated at higher speeds. Provided herein are embodiments of a sliding platform system wherein plural platforms are situated upon a rail and a drive system is mounted externally, eliminating the need for an electrical distribution system, flexibly connected wire and electric motor on or connected with each platform. The drive system is operable to move the platforms reciprocally along the rail.

In accordance with an embodiment a sliding platform system is disclosed having at least one platform with rollers positioned on and rotatably movable upon a rail, and a chain drive assembly or system including a chain, motor and sprockets, a chain guide channel, a latching mechanism mounted to the platform and slidably engageable in the chain guide channel, and a latch set mechanism.

In accordance with further embodiments, a sliding platform system includes a vehicle platform having a front and rear end, opposing sides between the front and rear end extending along a long axis of the platform, the platform having a top surface configured to accommodate a vehicle thereon and an opposite, bottom surface, at least two front end rollers mounted proximal the front end and extending from the bottom surface of the platform, at least two rear end rollers mounted proximal the rear end and extending from the bottom surface of the platform, wherein the front end rollers are in axial alignment with each other and the rear end rollers are in axial alignment with each other, and a latching mechanism coupled proximal to an end of the platform and extending from the bottom surface of the platform, the sliding platform system further including a first rail, a second rail, a chain guide channel positioned adjacent the first rail, a chain drive assembly including an endless chain mounted on axially aligned sprockets, wherein one of the sprockets is operably coupled to a motor, wherein the chain is positioned within and in axial alignment with the chain guide channel, the latching mechanism is positioned in and configured to move along the channel and the latching mechanism further includes a latch aperture through which the chain passes and a chain engagement element operable to releasably engage the chain, wherein in the engaged state movement of the chain is operable to move the latching mechanism and the platform along the chain guide channel, and wherein the chain guide channel further includes at least one detent formed in the channel configured to receive and retain a portion of the latching mechanism when the platform is moved to a desired position, and a latch set device operable to set and/or reset the latching mechanism.

In accordance with certain embodiments the latching mechanism is or includes a spring-loaded plunger which remains in a biased position in the chain guide channel due to force imparted against the plunger by a wall of the chain guide channel until it is positioned in axial alignment with the detent. This design enables the latch mechanism to slide freely within the chain guide channel until it is positioned in alignment with the detent, at which point the biasing force is removed and the plunger extends into the detent sufficiently to lock the platform in a desired position. The movement of the plunger into the detent also serves to disengage the chain engagement element from the chain, permitting the chain drive to operate to move an adjacent platform while preventing movement of the platform associated with the latching mechanism engaged in the detent.

In one or more embodiments the latching mechanism is operable to engage the drive chain and move the platform in the direction the drive chain is moving. The latching mechanism is operable to engage the drive chain in one or more positions. Once the platform starts moving, the chain guide channel is operable to keep the latching mechanism engaged with the drive chain. The latching mechanism is configured to disengage from the drive chain when the platform is in the proper position and the drive chain releases tension on the latching mechanism.

When the sliding platform reaches the proper position, which is defined by a detent, the plunger of the latching mechanism is operable to extend into the detent, disengaging the latch mechanism from the drive chain and holding the platform in position. The drive chain can then move freely through the latch aperture of the latching mechanism, allowing it to engage other platforms in the system.

In some embodiments the latch set device is a solenoid or actuator operably coupled to a push arm operable to exert force on a surface of the latch mechanism. The solenoid or actuator may be coupled to a switch, remote control or the like, via a wired or wireless connection, as is well-known in the art. The latch set device is optimally positioned adjacent to a detent in the chain guide channel, wherein the latch set device is operable to cause the latching mechanism to engage the drive chain. Once the drive chain has been engaged and starts to move the platform, the latching mechanism may be held in place by the chain guide channel until it reaches the next parking location.

The chain drive assembly may include a motor such as but not limited to an electric motor, hydraulic motor, or the like suitable to operate the drive chain coupled thereto. For example, and not by way of limitation, the chain drive assembly may include a variable speed electric motor of sufficient size to allow the platforms to be moved rapidly in either direction while controlling acceleration and deceleration.

The chain drive assembly may be mounted below the floor or above the floor or upon a structural member when used as part of a mechanical parking system.

The chain guide channel is of sufficient size and strength to accommodate the drive chain. The chain guide channel may include detents positioned at selected positions, such as but not limited to desired or proper parking locations, to allow the plunger of the latching mechanism extend into the detent.

The platform may include at least one drive on ramp, wheel stop and wheel runways. Parallel runways may be defined by curbs positioned longitudinally along the platform periphery. The runway curbs are used to confine the passage of vehicle tires in the runways and direct the vehicles onto the platform straightaway and are sized, dimensioned and positioned so that they keep an automobile substantially centered on the platform. In some embodiments the curbs are of such a width that the mirrors and other parts of the car that extend beyond the outside walls of the tires do not extend beyond the platform edge. This allows placement of adjacent platforms close together, conserving space from side to side, without hitting the mirrors of adjacent cars.

In one embodiment a drive-on ramp is disposed at an entrance end of the platform and may have sloped front and back ends so that as a car is driven onto the platform and onto the runway the sloped back end serves as a block to prevent the car rolling off the entrance end of the platform. A wheel stop at the platform end opposite the entrance end may be used. It will be apparent to those skilled in the art that drive on ramps may be disposed at either or both ends of the platform, as in some cases it may be desirable to accommodate entrance and exit of a car from either end of the platform.

The thickness of the platform employed in some embodiments is from about 2 mm to about 10 mm. This allows the wheels of the vehicle to be parked on the very bottom of the platform. Employing a minimal platform thickness, such as 2 mm, permits a reduction of space between the platform and the ground beneath the platform.

In accordance with still further embodiments a sliding platform system includes a vehicle platform having a front and rear end, opposing sides between the front and rear end, the platform further including a first pair of rollers mounted proximate the front end of the platform and extending vertically with respect to a horizontal plane of the platform and in axial alignment with the short axis of the platform, the first pair of rollers being positioned between the sides of the platform, and a second pair of rollers mounted proximal the rear end of the platform and extending vertically with respect to a horizontal plane of the platform and in axial alignment with the short axis of the platform, the second pair of rollers being positioned between the sides of the platform. In some embodiments, one or more additional rollers positioned in axial alignment with the first and/or second pair of rollers may be employed. It will be apparent to those skilled in the art that any suitable number of rollers may be employed.

In accordance with an embodiment, the first pair of rollers is mounted to a support bracket proximate the front end of the platform orthogonal to the opposing sides and the second pair of rollers is mounted to a support bracket on the rear end of the platform orthogonal to the opposing sides. The platform may include at least one latch mounting bracket extending vertically with respect to the horizontal plane attached to the roller support bracket at one end of the platform.

In other embodiments an additional latching mechanism and chain guide channel may be installed at the opposite end of the platform to engage a second drive system synchronized to the first drive system.

The sliding platform system of the disclosed embodiments allows the system to operate at a faster rate of speed than prior art systems. The systems disclosed herein also provide a major cost savings, at least insofar as material requirements, such as electrical distribution system and driving motors, over prior art systems. Due to the space-saving features, the disclosed systems can be used in confined spaces where other prior art systems cannot be deployed.

Sliding platforms and systems as disclosed herein may be used in connection with various lift systems. For example, they can be used at the ground level to create an empty space to be used for lowering a platform from the parking structure to the ground level in a system such as but not limited to that disclosed and described in U.S. patent application Ser. No. 15/432,980 filed Feb. 15, 2017 ("Lift-Slide Parking System") incorporated by reference herein in its entirety. By way of further example, the sliding platforms and systems can be used at the ground level with suspension lifts such as but not limited to those disclosed in U.S. patent application Ser. No. 15/071,284 filed Mar. 16, 2016, ("Suspension Lift"), incorporated by reference herein in its entirety.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE INVENTION

Figure 1:
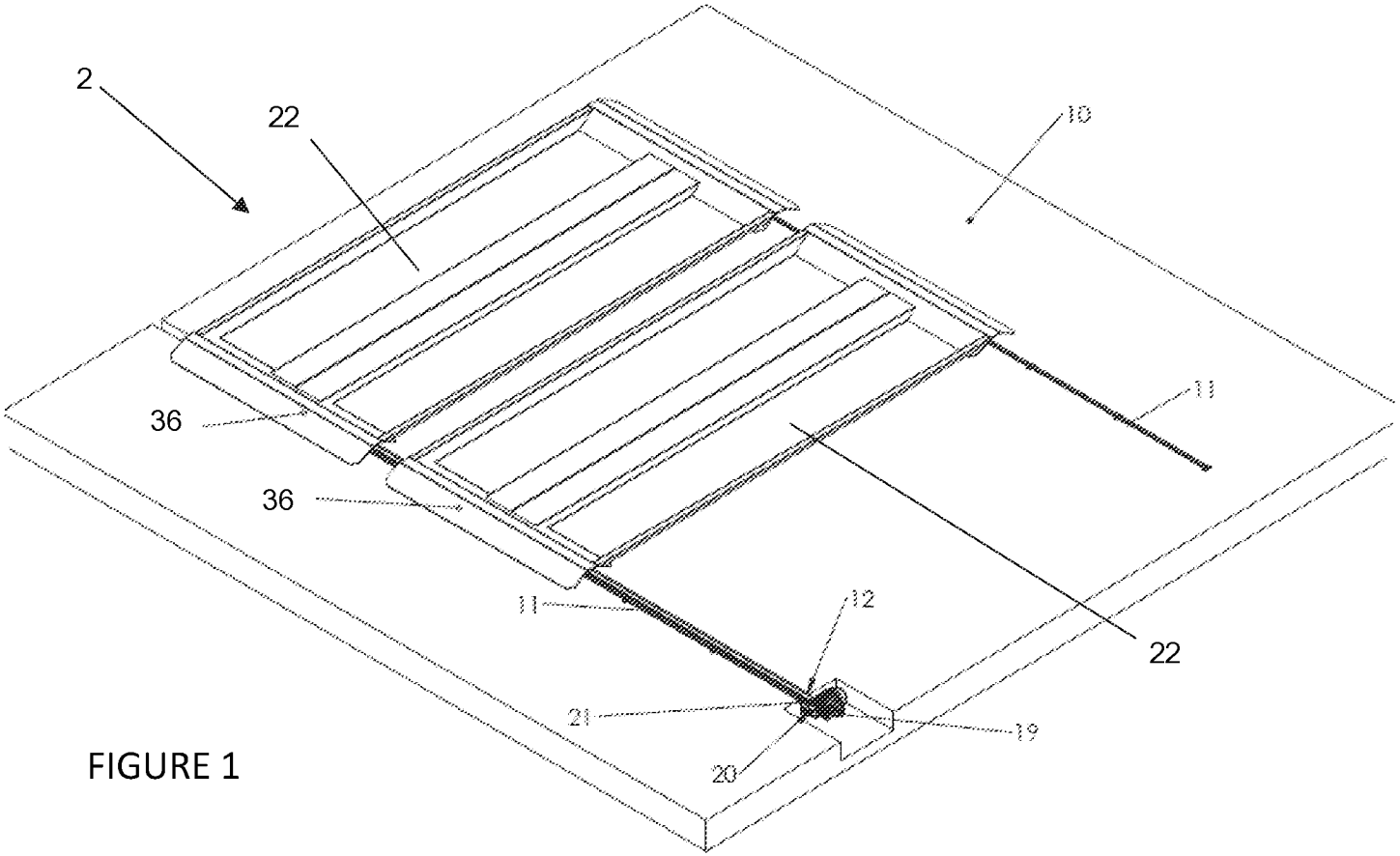
FIG. 1 is an elevated perspective view of a sliding platform system containing two platforms in their leftmost position operating over three parking spaces in accordance with an embodiment of the present disclosure.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although the systems described herein depict two platforms operating over three parking spaces, it will be understood by those skilled in the art that this depiction is merely exemplary and that any number of platforms can be employed and operated in linear fashion by the systems disclosed herein.

Figure 2:
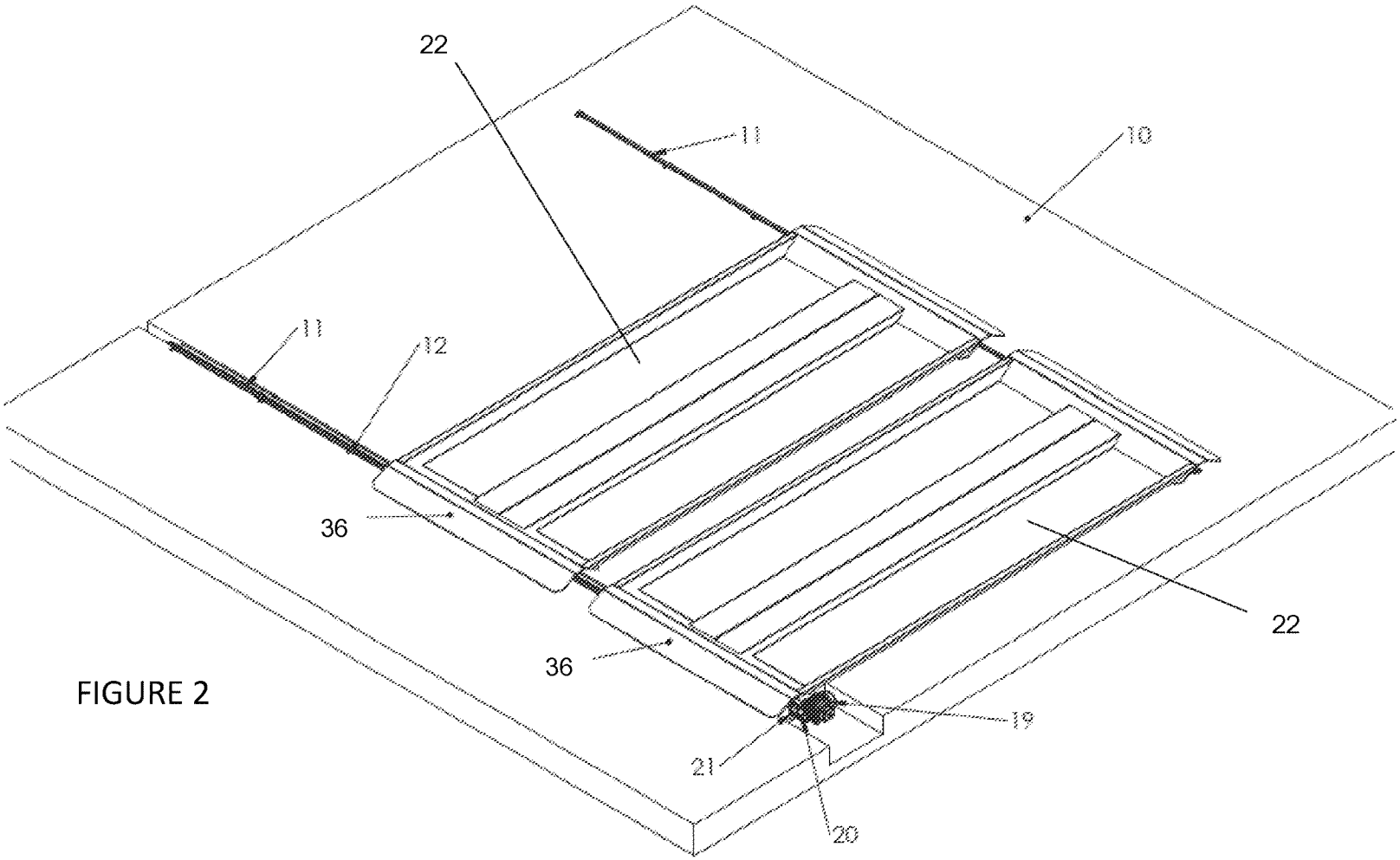
FIG. 2 is an elevated perspective view of a sliding platform system containing two platforms in their rightmost position operating over three parking spaces in accordance with an embodiment of the present disclosure.
Figure 3:
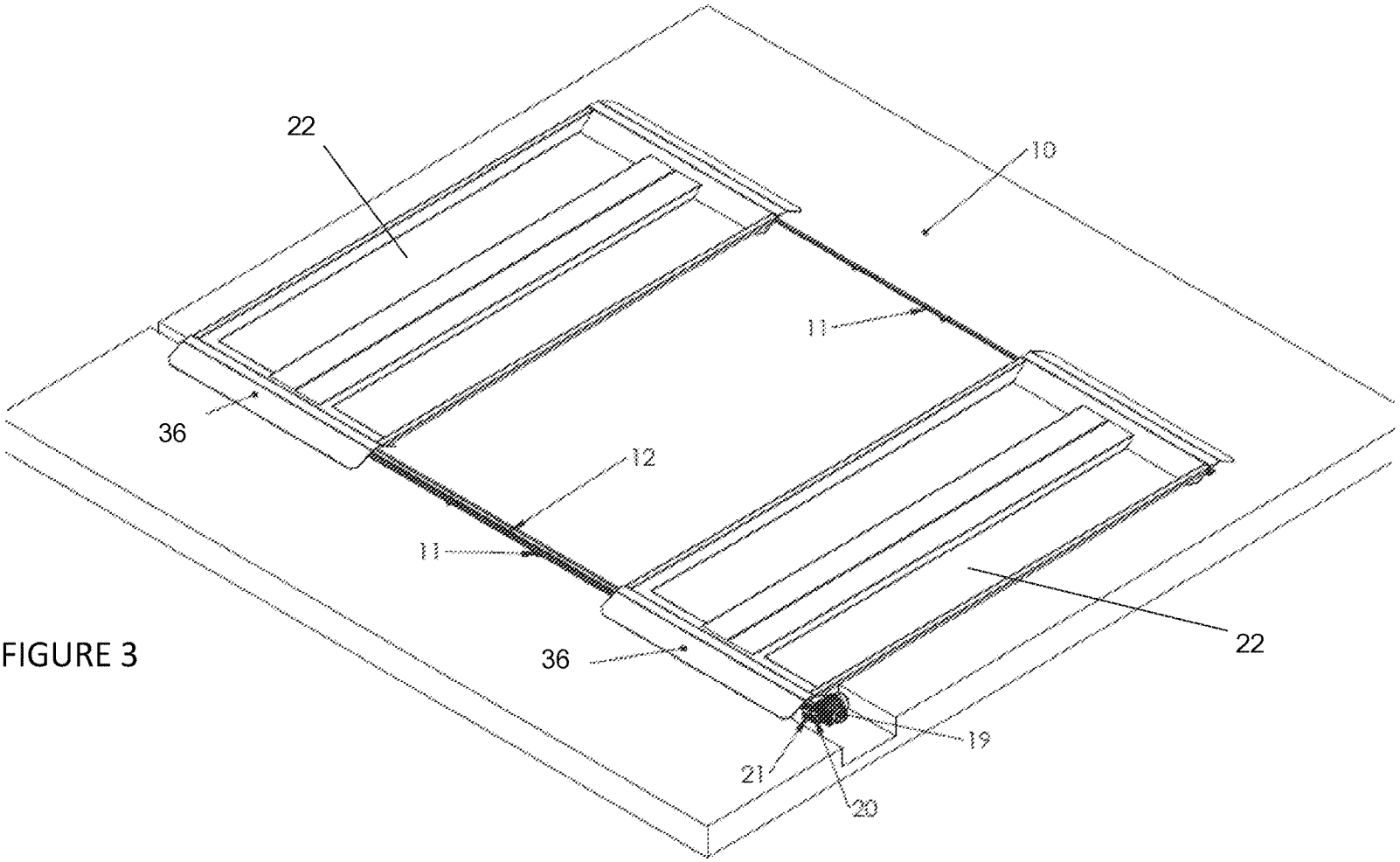
FIG. 3 is an elevated perspective view of a sliding platform system containing two platforms in their outermost positions operating over three parking spaces in accordance with an embodiment of the present disclosure.

Embodiments of the present invention will now be described with reference to the FIGURES. With reference to FIGS. 1-4, in accordance with an embodiment a slide platform system 2 includes a pair of sliding platforms 22 slidably mounted upon front and back guide rails 11 which are mounted on floor 10, a chain guide channel 12 and a chain drive assembly 18. The chain drive assembly includes motor 19, sprockets 20, and drive chain 21. The chain guide channel 12 and chain drive assembly 18 are shown mounted below the top surface of the floor 10, however it will be apparent to those skilled in the art that the chain drive channel 12 and chain drive assembly 18 can be mounted in other locations, such as upon a support structure, etc. FIG. 1 shows the two platforms 22 in the leftmost position. FIG. 2 shows both platforms 22 moved to the rightmost position. Both platforms 22 may be moved simultaneously from a leftmost position to a rightmost position or vice versa, or individually. By way of example and not limitation, FIG. 3 shows one platform 22 returned to its original leftmost position as shown in FIG. 1 while the second platform remains in its rightmost position.

It will be apparent to those skilled in the art that the number of platforms 22 that can be employed in the system 2 is only limited by space and equipment constraints. In some embodiments the system 2 may include from one to ten platforms 22. In other embodiments the system 2 may include more than ten platforms 22.

Figure 4:
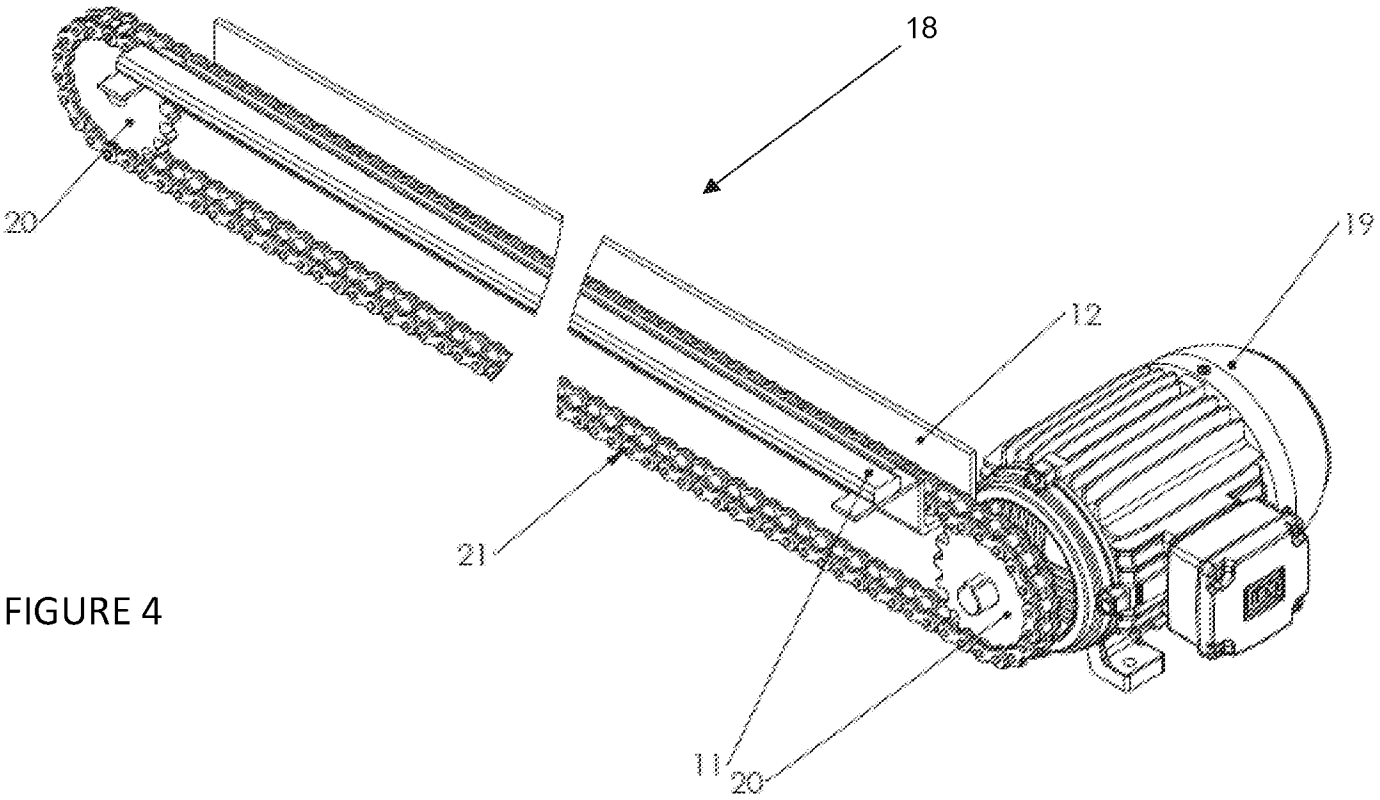
FIG. 4 is an elevated perspective view of a chain drive assembly motor, sprockets, chain and chain guide channel in accordance with an embodiment of the present disclosure.

With reference to FIG. 4, the chain drive assembly includes a motor 19, sprockets 20 and a drive chain 21. The distance between the sprockets 20, the length of the drive chain 21 and the length of the chain guide channel 12 will be determined by the number of platforms 22 being used in a given system 2.

The motor 19 may be any suitable motor such as but not limited to an electric motor, hydraulic motor, or the like suitable to operate the drive chain 21 coupled thereto. For example, and not by way of limitation, the motor 19 may be a variable speed electric motor of sufficient size to allow the platforms 22 to be moved rapidly in either direction while controlling acceleration and deceleration.

The chain guide channel 12 is positioned adjacent a rail 11 at one end of a platform 22 or series of platforms 22. In some embodiments a chain guide channel 12 may be positioned adjacent a rail 11 at each end of the platform or platforms 22. The drive chain 21 is positioned within and in axial alignment with the chain guide channel 12. As further described hereinbelow, the drive chain 12 is routed through one or more latch mechanisms which depend from the platform(s) 22 and are slidably coupled to the chain guide channel 12.

Figure 5:
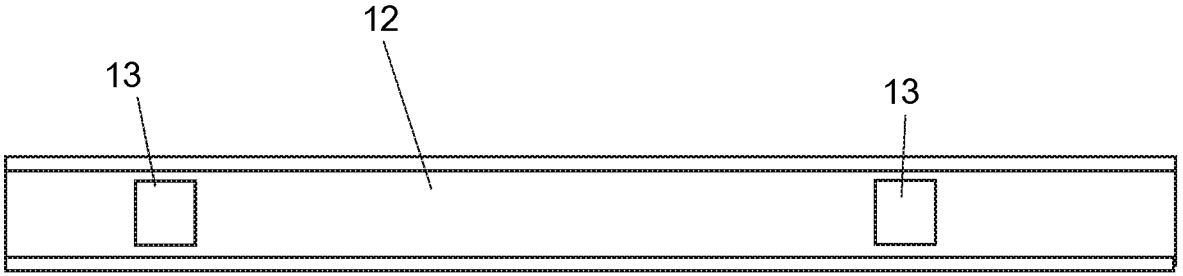
FIG. 5 is a top plan view of a channel and detents formed therein in accordance with an embodiment of the present disclosure.

Now referring to FIG. 5, the chain guide channel 12 includes detents 13 formed therein to receive a latch mechanism extending from a platform, as described in further detail hereinbelow. The chain guide channel 12 may include several detents 13 to accommodate either a single latch mechanism on a single platform, to provide locking positions for the platform, and/or to accommodate the latch mechanisms of plural platforms.

Figure 6:
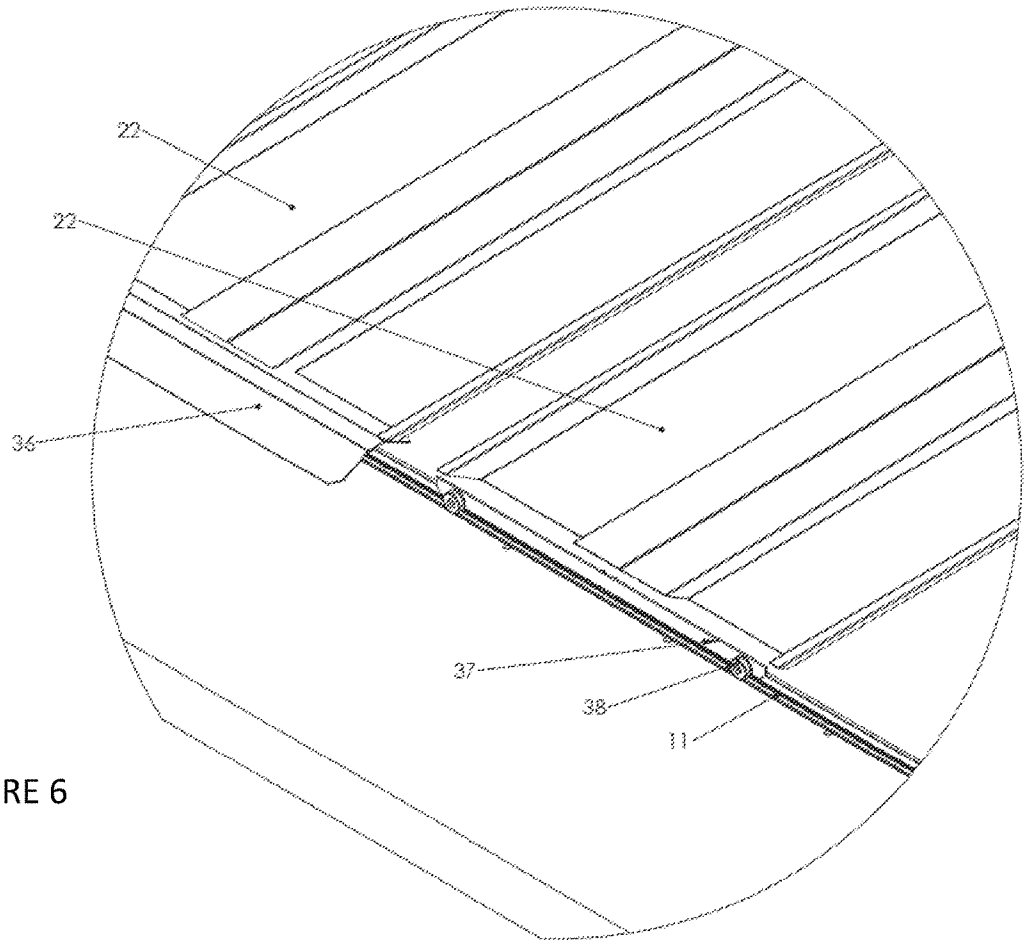
FIG. 6 is a an elevated perspective view of platforms showing platform rollers aligned along a guide rail in accordance with an embodiment of the present disclosure.
Figure 7:
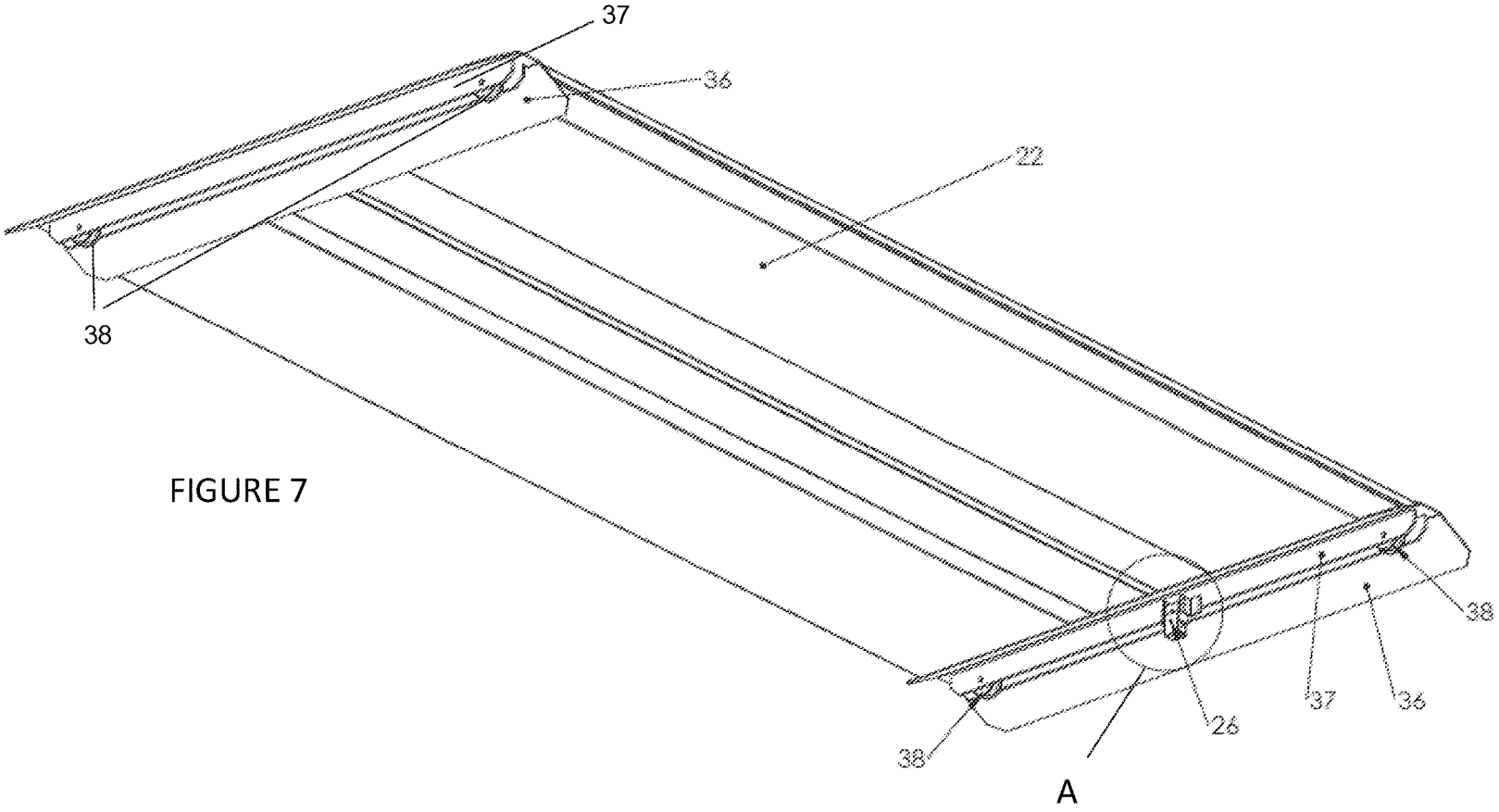
FIG. 7 is an bottom perspective view of the underside of a platform of a sliding platform system depicting platform rollers and a latch mechanism in accordance with an embodiment of the present disclosure.

With reference to FIG. 6, two platforms 22 are shown positioned adjacent each other on rail 11. The platform 22 on the left is shown with ramp 36 while the platform 22 on the right is shown with a ramp removed to reveal support bracket 37 to which are mounted rollers 38. With further reference to FIG. 7, support brackets 37 supporting rollers 38 are positioned proximal each end of platform 22. The rollers 38 are configured and operable to be positioned on the rails 11 to enable the platform 22 to glide along the rail.

Figure 7A:
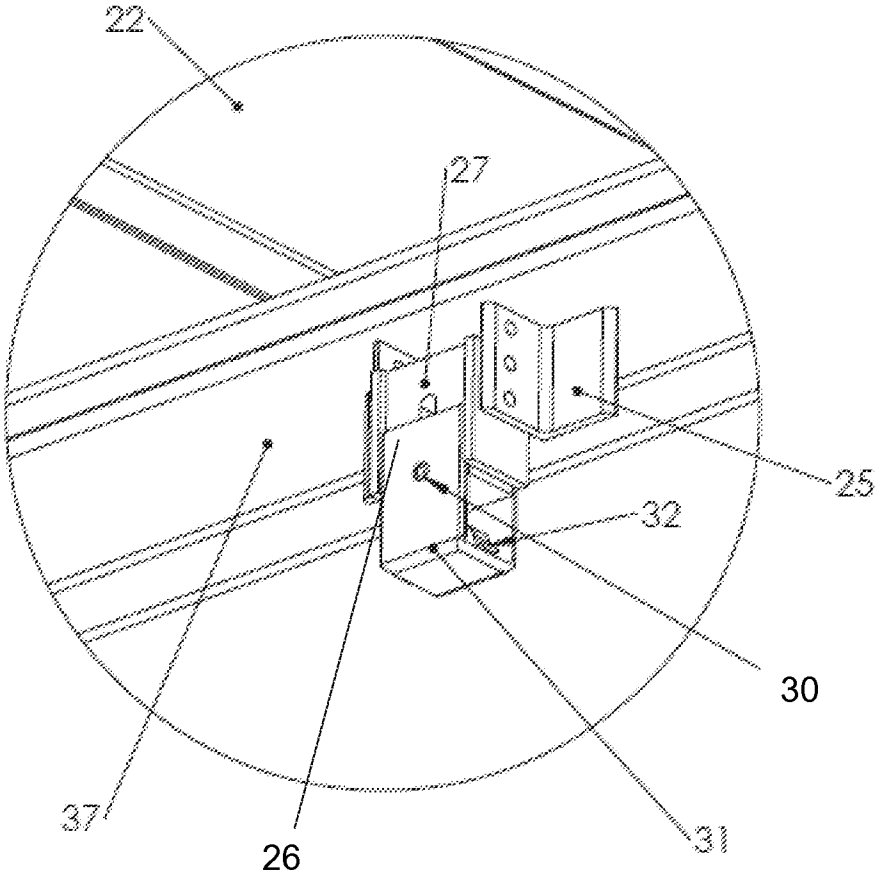
FIG. 7A is a perspective view of detail A of FIG. 7 depicting a latch assembly mechanism in accordance with an embodiment of the present disclosure.
Figure 8B:
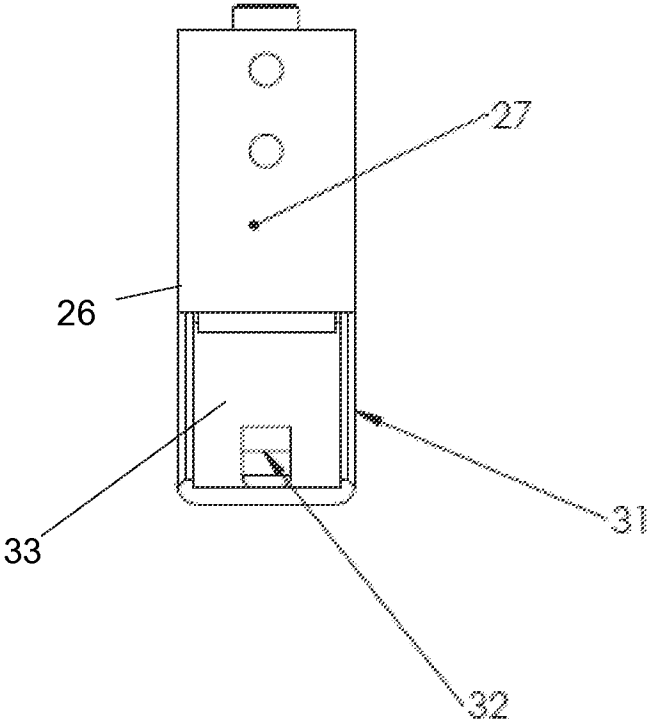
FIGS. 8A-8E depict, respectively, an elevated perspective view (FIG. 8A), a side view (FIG. 8B), a front view (FIG. 8C), a top plan view (FIG. 8D) and a cross-sectional view (FIG. 8E, taken along line D-D of FIG. 8D) of a latch mechanism in accordance with an embodiment of the present disclosure.
Figure 8A:
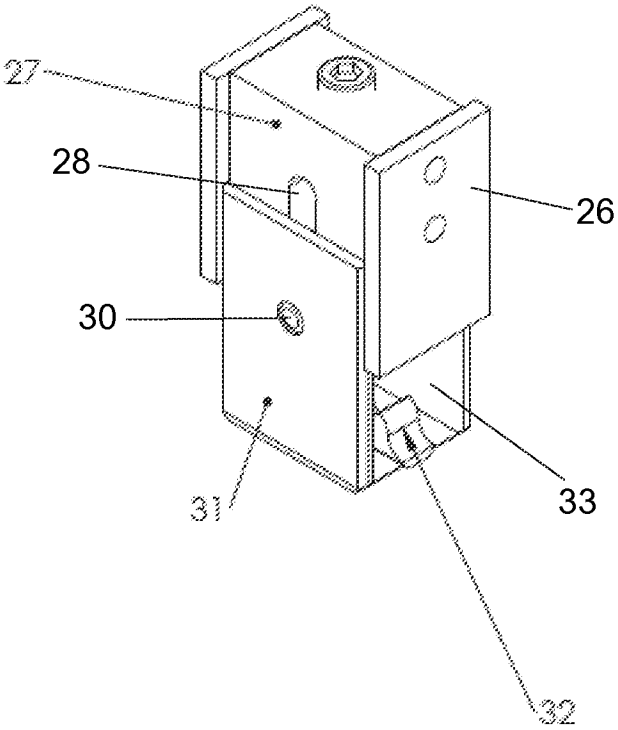
Figure 8E:
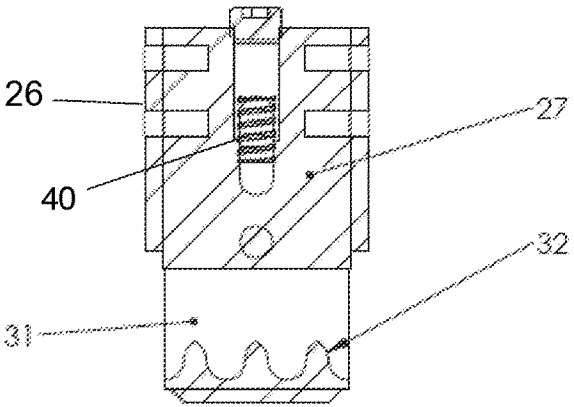
Figure 8D:
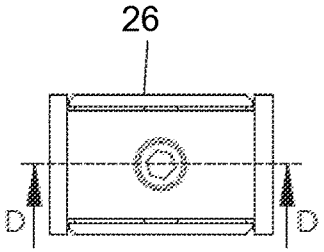
Figure 8C:
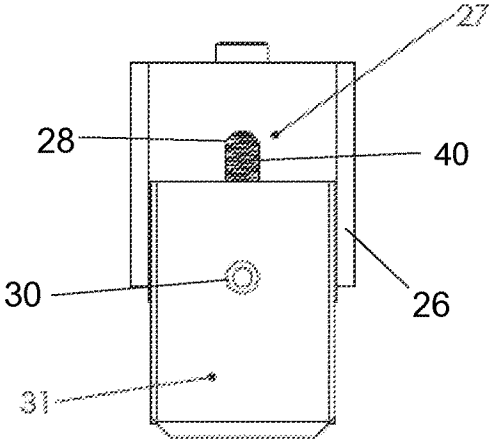

With further reference to FIG. 7A, a latch mechanism 26 is coupled to support bracket 37 for example via a fastening device such as but not limited to one or more latch mount brackets 25. The latch mechanism 26 is shown in the unlatched, or extended position. In some embodiments the latch mechanism 26 is oriented such that it is extendible approximately orthogonal to the plane of the platform.

FIGS. 8A-8E show the latch mechanism 26 in the unlatched, or extended, position. The latch mechanism 26 includes an upper body 27 which as shown in FIG. 7A is fixed relative to the support bracket 37, and a plunger 31 which is movable reciprocally relative to the upper body 27 and which contains chain engagement teeth 32. The plunger 31 is sized and configured to engage a detent 13 of the chain guide channel 12. In one embodiment the plunger 31 is a generally U-shaped element having a pin 30 slidably engaged in a slot 28 formed in the upper body 27. A biasing element 40 positioned in an interior of the upper body 27 provides resistance against vertical or upward movement of the plunger 31. The upper body 27 serves as a support and/or attachment point for the latch mechanism 26 to be coupled to the latch mount bracket 25, the plunger 31, and the chain engagement teeth 32 which, when raised, engage the drive chain 21 and cause the platform 22 to move. The latch mechanism 26 includes latch aperture 33 which is sized and configured to accommodate the passage therethrough of drive chain 21. In the latched position, the chain engagement teeth 32 are operable to engage the drive chain 21. In the unlatched position, the chain engagement teeth 32 cannot engage the drive chain 21, and the drive chain 21 is able to move through the latch aperture 33 without moving the latch mechanism and hence, the platform 22.

The plunger 31, being spring-loaded, remains in a biased position in the chain guide channel 12 due to force imparted against the plunger 31 by a wall of the chain guide channel 12 until it is positioned in axial alignment with a detent 13. This design enables the latch mechanism 26 to slide freely within the chain guide channel 12 until it is positioned in alignment with the detent 12, at which point the biasing force is removed and the plunger 31 extends into the detent 13 sufficiently to lock the platform 22 in a desired position. The movement of the plunger 31 into the detent 13 also serves to disengage the chain engagement teeth 32 from the drive chain 21, permitting drive chain to operate to move an adjacent platform while preventing movement of the platform associated with the latching mechanism engaged in the detent.

Figure 9:
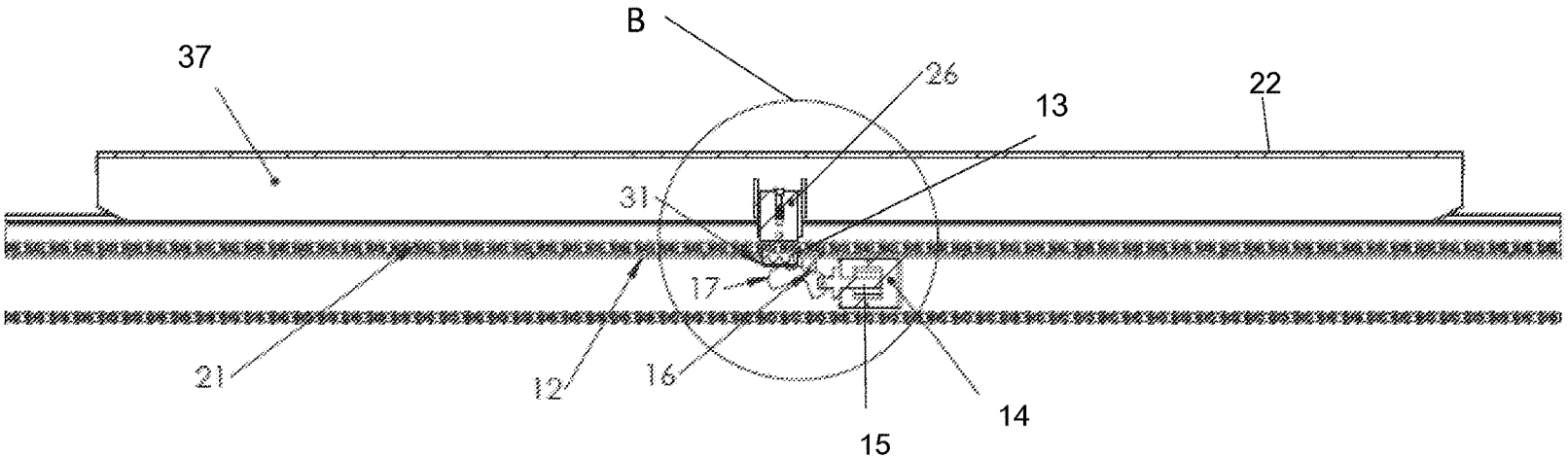
FIG. 9 is a frontal cutaway view of a sliding platform system showing a drive chain, latch mechanism and latch set device in relation to a platform and chain guide channel in accordance with an embodiment of the present disclosure.
Figure 9A:
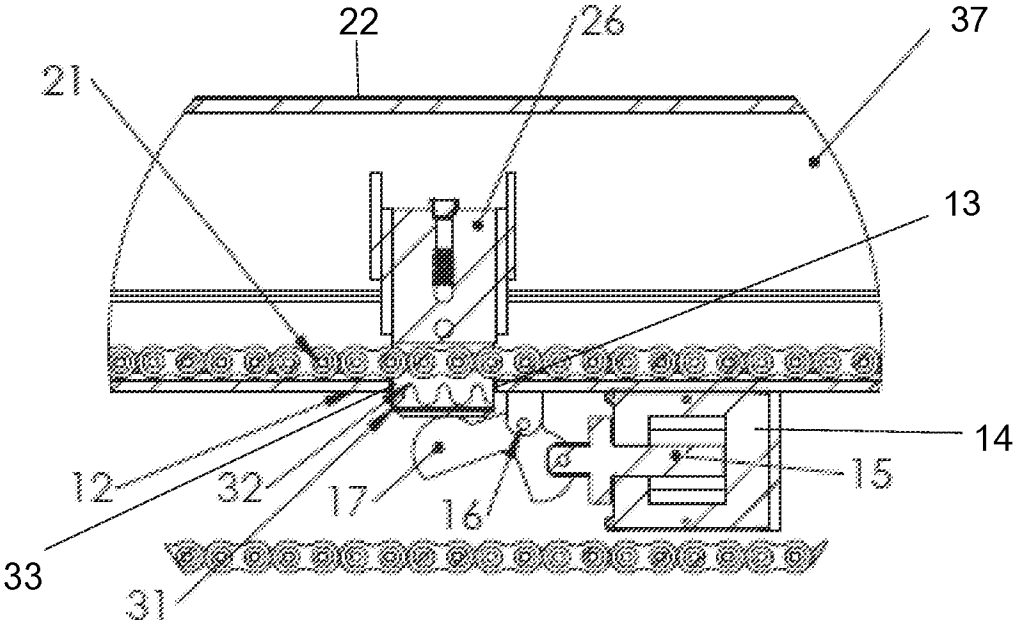
FIG. 9A is a magnified view of detail B of FIG. 9 showing the drive chain, latch mechanism and latch set device in relation to the platform and chain guide channel in accordance with an embodiment of the present disclosure.
Figure 9B:
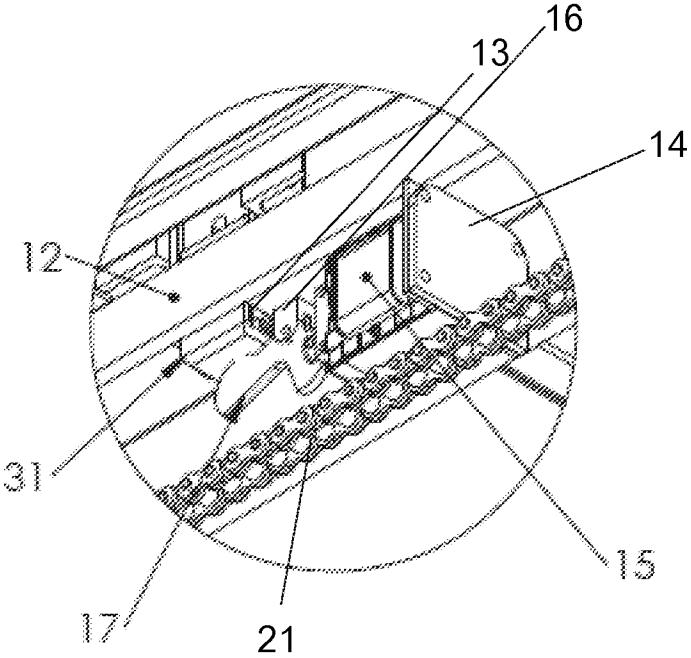
FIG. 9B is a bottom perspective view of FIG. 9A, showing the drive system, latch mechanism and latch set device in the unlatched position holding the platform in place in accordance with an embodiment of the present disclosure.
Figure 10:
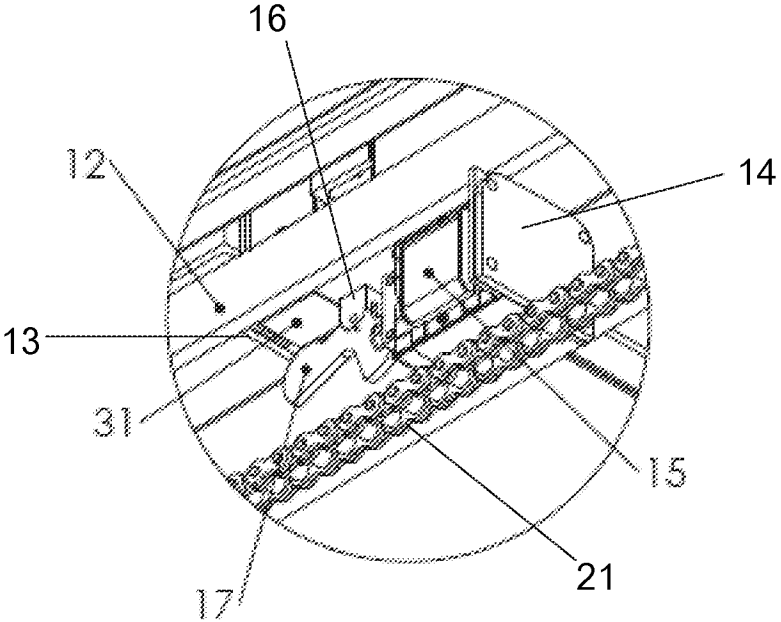
FIG. 10 is a bottom perspective view of the underside of a sliding platform system showing the drive system, latch mechanism and latch set device in the latched position.

Now referring to FIGS. 9 and 9A a latch set device 14 is positioned adjacent each of the detents 13. The latch set device 14 is operable to set the latch mechanism 26, that is, to move the plunger 31 from the extended, or unlatched, position, in which the drive chain is disengaged from the chain engagement teeth and the plunger is seated in the detent 13, to the unextended position. The latch set device 14 may be any suitable device such as but not limited to an actuator or a solenoid 15 operably coupled to a push arm 17 pivotably mounted to an arm pivot 16. The solenoid or actuator may be coupled to a switch, remote control or the like, via a wired or wireless connection, as is well-known in the art. FIG. 9 shows the latch mechanism 26 in position on mounting bracket 37 with the drive chain 21 passing through the latch aperture 33 of latch mechanism 26. Plunger 31 is positioned in detent 13 in the chain guide channel 12. FIG. 9A shows the chain engagement teeth 32, when in the lowered position, extend through the detent 13 and are below the bottom of the chain guide channel 12, allowing the drive chain 21 to travel freely through the latch aperture 33, thereby operating without being able to move or otherwise affecting the associated platform 22. With further reference to FIG. 9B, the actuator 15 of the latch set device 14 is operable to urge push arm 17, which pivots against arm pivot 16 and urges the plunger in to a latched, or unextended, position. With further reference to FIG. 10, the latch set device 14 has urged push arm 17 such that the plunger 31 has moved to the latched position, allowing engagement with the drive chain 21. As soon as the drive chain 21, engaged to the chain engagement teeth 32, moves, the movement causes the plunger 31 to slide in the chain guide channel 12, and the plunger 31 is held in the engaged position until it reaches the next detent 13 in the chain guide channel 12.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A sliding platform system for moving a vehicle parked on a platform, the sliding platform system comprising at least one rail and at least one vehicle platform slidably movable upon the at least one rail, a chain drive assembly comprising a chain, motor and sprockets, a chain guide channel positioned adjacent the at least one rail, and at least one latching mechanism mounted to the platform and slidably engaged in the chain guide channel, wherein the chain drive assembly is operably coupled to the latching mechanism and wherein a portion of the chain is positioned in the chain guide channel, wherein the chain guide channel comprises at least one detent operable to engage the latching mechanism when the latching mechanism is positioned in alignment with the detent.

2. The invention of claim 1 wherein the vehicle platform comprises a front and rear end, opposing sides between the front and rear end extending along a long axis of the platform, the platform having a top surface configured to accommodate a vehicle thereon and an opposite, bottom surface.

3. The invention of claim 2 wherein the vehicle platform comprises at least two front end rollers mounted proximal the front end and extending from the bottom surface of the platform, and at least two rear end rollers mounted proximal the rear end and extending from the bottom surface of the platform, wherein the front end rollers are in axial alignment with each other and the rear end rollers are in axial alignment with each other, wherein the front end rollers are positioned on a first of the at least one rail and the rear end rollers are positioned on a second of the at least one rail.

4. The invention of claim 2 wherein the latching mechanism is coupled proximal to an end of the platform and extends from the bottom surface of the platform.

5. The invention of claim 1 wherein the chain drive assembly comprises an endless chain mounted on axially aligned sprockets, wherein one of the sprockets is operably coupled to the motor, wherein the chain is positioned in axial alignment with the chain guide channel, and wherein the latching mechanism comprises a latch aperture through which the chain passes and a chain engagement element operable to releasably engage the chain, wherein in the engaged state movement of the chain is operable to move the vehicle platform along the at least one rail and the latching mechanism along the chain guide channel.

6. The invention of claim 5, wherein the latching mechanism comprises a spring-loaded plunger which is operable to remain in a biased position in the chain guide channel due to force imparted against the plunger by a wall of the chain guide channel until it is positioned in axial alignment with the detent.

7. The invention of claim 6, wherein the latch mechanism is operable to slide freely within the chain guide channel until it is positioned in alignment with the detent, and to extend into the detent sufficiently to lock the platform in a desired position.

8. The invention of claim 7 wherein movement of the plunger into the detent is operable to disengage the chain engagement element from the chain, permitting the chain to move through the latch aperture and permitting the chain drive assembly to operate to move an adjacent platform while preventing movement of the platform associated with the latching mechanism engaged in the detent.

9. The invention of claim 8, further comprising a latch set device operable to move the latch mechanism to an engaged state with the chain.

10. The invention of claim 9 wherein the latch set device is positioned adjacent to a detent in the chain guide channel and comprises an actuator operably coupled to a push arm operable to exert force on a surface of the plunger in opposition to a biasing force imparted by the latching mechanism.

11. The invention of claim 1 comprising plural vehicle platforms.

12. A sliding platform system comprising:

at least one vehicle platform having a front and rear end, opposing sides between the front and rear end, the platform further including a first pair of rollers mounted proximate the front end of the platform and extending vertically with respect to a horizontal plane of the platform and in axial alignment with a short axis of the platform, the first pair of rollers being positioned between the sides of the platform, and a second pair of rollers mounted proximal the rear end of the platform and extending vertically with respect to a horizontal plane of the platform and in axial alignment with the short axis of the platform, the second pair of rollers being positioned between the sides of the platform;

at least one rail upon which the at least one vehicle platform is slidably mounted;

a chain drive assembly comprising a chain, motor and sprockets;

a chain guide channel positioned adjacent the at least one rail and comprising at least one detent;

a latching mechanism mounted proximal to an end of the platform and extending from a bottom surface of the platform and slidably engaged in the chain guide channel, the latching mechanism comprising a latch aperture sized and configured to accommodate the passage of the chain therethrough, and further comprising a chain engagement element operable to selectably engage the chain; and a latch set device mounted adjacent the at least one detent, wherein the chain drive assembly is operably coupled to the latching mechanism and wherein a portion of the chain is positioned within and in axial alignment with the chain guide channel, wherein the at least one detent is operable to engage the latching mechanism when the latching mechanism is positioned in alignment with the detent and wherein positioning of the latching mechanism in the detent is operable to disengage the chain from the chain engagement element.

13. The invention of claim 12 wherein the latch set device comprises an actuator operably coupled to a push arm operable to exert force on a surface of the latch mechanism in opposition to a biasing force imparted by the latching mechanism.

14. The invention of claim 12 comprising plural vehicle platforms.

* * * * *